US006719015B2

(12) United States Patent
Murray

(10) Patent No.: US 6,719,015 B2
(45) Date of Patent: Apr. 13, 2004

(54) APPARATUS AND PROCESS FOR MANUFACTURING A FILLED FLEXIBLE POUCH

(75) Inventor: R. Charles Murray, Sarasota, FL (US)

(73) Assignee: PPL Technolgies, L.L.C., Sarasota, FL (US)

( * ) Notice: Subject to any disclaimer, the term of this patent is extended or adjusted under 35 U.S.C. 154(b) by 0 days.

(21) Appl. No.: 10/336,601

(22) Filed: Jan. 3, 2003

(65) Prior Publication Data

US 2003/0127151 A1 Jul. 10, 2003

Related U.S. Application Data

(60) Provisional application No. 60/345,230, filed on Jan. 4, 2002.

(51) Int. Cl.[7] ..... B65B 1/04

(52) U.S. Cl. ..... 141/10; 141/114; 141/314; 53/570

(58) Field of Search ..... 141/114, 10, 313–317; 53/562, 563, 570, 574, 578, 579

(56) References Cited

U.S. PATENT DOCUMENTS 733,449 A * 7/1903 Willsie ..... 141/75
2,703,671 A * 3/1955 Kindseth ..... 141/75
4,326,568 A * 4/1982 Burton et al. ..... 141/114
5,222,535 A * 6/1993 Roders ..... 141/314

* cited by examiner

*Primary Examiner*—Steven O. Douglas
(74) *Attorney, Agent, or Firm*—Gifford, Krass, Groh, Sprinkle, Anderson & Citkowski, P.C.

(57) ABSTRACT

An apparatus and process for manufacturing a filled flexible pouch is provided. The apparatus includes a cylindrical cup member having an open upper end, a closed lower end and a side wall extending therebetween the upper end and lower end. An inside portion of the side wall includes a pair of opposed guide channels for receiving the flexible pouch, and the side wall includes a slot positioned adjacent guide member. The side wall includes a notched opening positioned above each of the guide channels. The apparatus also includes a pouch opening lever arm pivotally attached to the side wall of the cup member, having a lower portion below the pivotal attachment with a wheel at an outer end and an upper portion above the pivotal attachment with an outwardly extending push member at an outer end. The manufacturing process includes the steps of placing the flexible pouch into the guide channels of the cylindrical cup member, while the lever arm is pivoted outwardly. The process also includes the steps of opening the pouch by engaging the wheels of the lever arm by a lifting surface disposed below a transport means to pivotally move the pushing member through the notched opening to push apart the front and back panels, and filling the pouch with the product using a fill nozzle positioned above the opened pouch.

13 Claims, 2 Drawing Sheets

APPARATUS AND PROCESS FOR MANUFACTURING A FILLED FLEXIBLE POUCH

RELATED APPLICATION

This application claims priority of U.S. Provisional Patent Application Ser. No. 60/345,230 filed Jan. 4, 2002, which is incorporated herein by reference.

BACKGROUND OF THE INVENTION

1. Field of the Invention

The present invention relates generally to flexible pouches for packaging a product and, more specifically, to an apparatus and process for manufacturing a filled flexible pouch during operations such as opening, filling and sealing.

2. Description of the Related Art

Various types of disposable, portable containers are known in the art for storing a fluid or dry product, such as a liquid, granular material, powder or the like. One example of such a container is a flexible pouch. Consumers prefer the convenience of flexible pouches, due to their shape and size. Manufacturers recognize the packaging benefits of a flexible pouch, since the pouch can be formed and filled on the same manufacturing line. An example of a method and apparatus for filling a flexible pouch with a product is disclosed in commonly assigned U.S. Pat. No. 6,199,601, which is incorporated herein by reference.

The flexible pouch is made from a flexible material, preferably a laminate composed of sheets of plastic or aluminum or the like. In this example, the material is available in sheet form, on a roll. An outer layer of the material may include preprinted information, such as a logo, or the like, to provide the consumer with information regarding the contents of the pouch. The pouch may be formed using conventionally known manufacturing techniques, such as a horizontal form-fill seal machine, a flat bed pre-made pouch machine, a vertical form fill machine, or the like. The pouch manufacturing and filling apparatus forms a predetermined shape for the pouch by folding sheets of material over each other. Alternatively, the pouch may be formed by laying one layer of material over a second layer of material and forming a gusset along two parallel edges to form a pouch capable of standing unsupported. Edges, such as the side edge and bottom edge, are joined together using a joining technique such as bonding or welding. The upper edges are not sealed together until after the pouch is filled.

The pouch manufacturing and filling apparatus may include a holder, such as a puck or cylindrical cup, into which the pouch is placed after it is formed. The cup holds the pouch through operations, such as opening, filling, sealing and finishing, and supports the weight and volume of the pouch and filler material. The pouch manufacturing and filling apparatus may include a plurality of cups arranged in a predetermined order, such as a carousel arrangement, with the pouch being placed in a cup or other support device at one station and then rotated from station to station. In the past, a simple cup-shaped holder was utilized, and the pouch was not filly supported. Thus, there is a need in the art for a reliable apparatus and process for supporting and transporting a flexible pouch during manufacturing operations, such as opening, filling, sealing and finishing operations.

SUMMARY OF THE INVENTION

Accordingly, the present invention is an apparatus and process for manufacturing a filled flexible pouch. The flexible pouch includes a front panel joined to a back panel at side edges and lower edges to contain a product within the flexible pouch. The apparatus includes a cylindrical cup member having an open upper end, a closed lower end and a side wall extending therebetween the upper end and lower end. An inside portion of the side wall includes a pair of opposed guide channels for receiving the flexible pouch, and the side wall also includes a slot positioned adjacent the guide channel. The sidewall includes a notched opening positioned above each of the guide channels. The apparatus also includes a pouch opening lever arm pivotally attached to the side wall of the cup member, wherein the pouch opening lever includes a lower portion below the pivotal attachment point having a wheel at an outer end and an upper portion above the pivotal attachment point having an outwardly extending push member at an outer end.

The process of manufacturing the filled flexible pouch includes the steps of placing the flexible pouch into the guide channels of the cylindrical cup member, while the pouch opening lever is pivoted outwardly. The process also includes the steps of opening the pouch by engaging the wheels of the pouch opening lever by a lifting surface disposed below a transport means, to pivotally move the pushing member through the notched opening in the cup member to push apart the front and back panels, and filling the pouch with the product using a fill nozzle positioned above the opened pouch. The process further includes the steps of closing the pouch by pivotally moving the pouch opening lever away from the pouch, sealing the upper edge of the panels and removing the filled pouch from the cup member.

One advantage of the present invention is that an improved pouch manufacturing apparatus is provided for transporting a flexible pouch during operations such as opening, filling and sealing. Another advantage of the present invention is that the improved apparatus includes a cup-shaped holder that supports the pouch within the holder. A further advantage of the present invention is that an improved process of preparing a flexible pouch is provided that is more cost-effective, since the operations, such as pouch opening, filling, and sealing are more reliably performed.

Other features and advantages of the present invention will be readily appreciated, as the same becomes better understood after reading the subsequent description taken in conjunction with the accompanying drawings.

DESCRIPTION OF THE PREFERRED EMBODIMENT(S)

Figure 1:
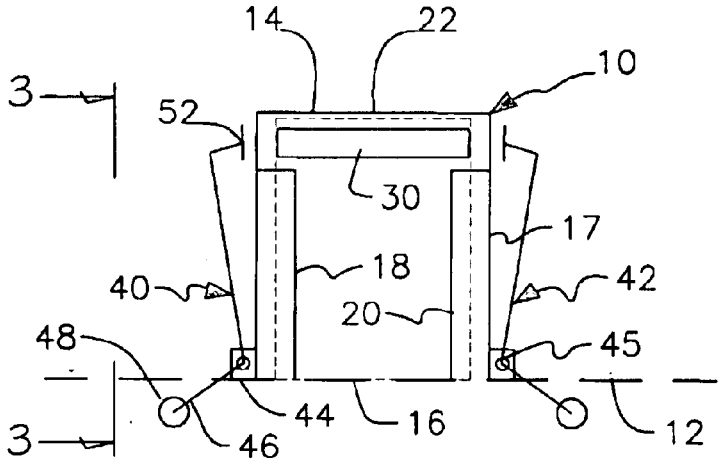
FIG. 1 is a side elevational view of an apparatus for transporting a flexible pouch during manufacturing operations, according to the present invention.
Figure 2:
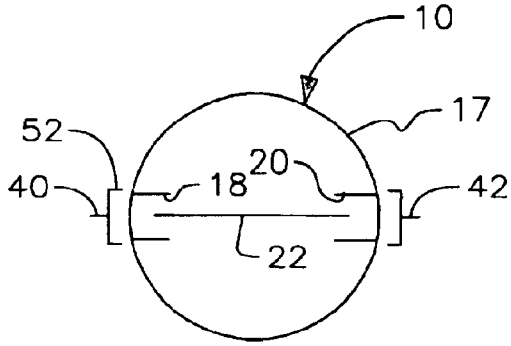
FIG. 2 is a top view of the cup member of FIG. 1, according to the present invention.
Figure 3:
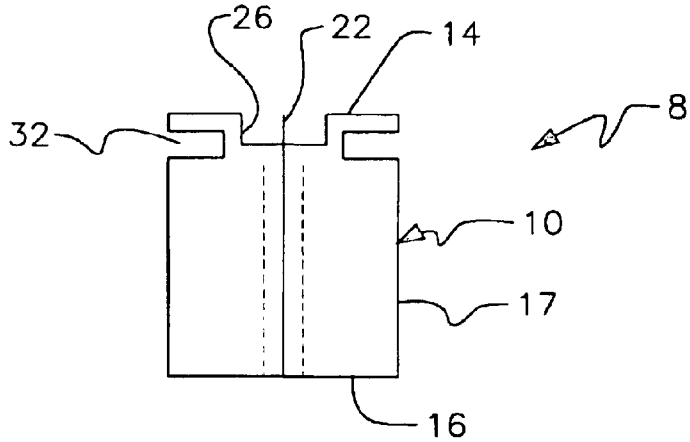
FIG. 3 is a sectional view of the cup member taken along lines 3—3 of FIG. 1, according to the present invention.

Referring to FIGS. 1–3, a portion of an apparatus 8 for transporting a flexible pouch during manufacturing operation is illustrated. In particular, the apparatus 8 is illustrated in conjunction with conventionally known operations for forming, filling, and sealing the pouch. These operations are by way of example, and other operations are known, such as a finishing operation. A pouch forming operation is described in commonly assigned U.S. Pat. application Ser. No. 10/310,221, filed Dec. 5, 2002, which is incorporated herein by reference.

In a pouch forming station, the pouch 22 is configured to have a front panel 22*a* and a back panel 22*b* that are joined together to form a pouch 22 having an upper edge 22*c*, a lower edge 22*d*, and two side edges 22*e* extending therebetween the upper and lower edges 22*c*, 22*d* respectively. In this example, each panel 22*a*, 22*b* has a generally rectangular shape, although other shapes are contemplated. The pouch 22 may include a side wall (not shown) disposed between the side edges and lower edge, which allows the pouch 22 to stand upright. For example, a gusset may be formed in the side walls, which is generally wider at the lower edge, and tapers upwardly towards the upper edge. The pouch 22 may include other conventionally known features, such as a dimple (not shown) for receiving a straw. Similarly, the upper edge of the pouch 22 may include a weakened area, to facilitate opening the pouch 22.

In a filling station, the pouch 22 is opened and filled with a product (not shown). Various fluid and dry products are contemplated, such as juice, chips, dog food, shredded cheese or the like. The filled pouch 22 is sealed in a sealing operation and finished in a finishing operation. It should be appreciated that other components or features may be added to the pouch in the finishing operation. For example, a straw (not shown) may be attached to the pouch 22.

The apparatus 8 is fixedly attached to a transport means 12, such as a conveyor belt or a turret, or the like, for moving the apparatus 8 between stations. In this example, a conveyor belt is illustrated.

The apparatus 8 includes a cup shaped member 10 for supporting the flexible pouch 22 during manufacturing operations, such as the opening, filling, and sealing operations. The cup 10 is fixedly attached to the transport means, such as by bolting or the like. The cup 10 is a generally cylindrical member with an open upper end 14, a closed lower end 16 and a cylindrical side wall 17 extending therebetween the upper end 14 and lower end 16. An inside portion of the cylindrical side wall 17 includes guide channels 18 and 20 that each form a guide slot to hold the side edges 22*e* of the pouch 22 generally centered in the cup 10. The guide channels 18, 20 preferably are positioned directly across from one another. In this example, the guide channels 18, 20 are positioned at the 9 o'clock and 3 o'clock positions respectively, for reference purposes.

Referring to FIG. 3, the upper end 14 of the cup includes a notched opening, as shown at 26. The notched opening 26 projects in a downwardly direction, and is positioned directly above each of the guide channels 18, 20.

The cylindrical side wall 17 may also include a slot or window as shown at 30 and 32. The slot 30,32 is preferably positioned near the upper end 14 of the cup 10 and intermediate the guide channels 18, 20. In this example, there are two slots 30 and 32, and each extends a portion of the way around the perimeter of the cup 10. Also in this example, the slots 30,32 are positioned such that they are centered at the 12 o'clock and 6 o'clock positions respectfully, and extend from approximately the 10 o'clock to the 2 o'clock position and from the 4 o'clock to the 8 o'clock positions, respectively, for reference purposes.

The apparatus 8 also includes pouch opening lever arms 40 and 42 for opening the pouch 22 prior to filling the pouch 22. In this example, the pouch opening levers 40, 42 are located generally at the 9 o'clock and 3 o'clock positions respectively. The pouch opening lever arms 40,42 are pivotally attached to the sides of the cup 10, using a support tab 44 on the side of the cup 10 adjacent its lower end 16 at an attachment pivot point 45. Each lever arm 40, 42 has a lower lever arm portion 46 that extends outwardly and downwardly from the attachment pivot point 45 and terminates in a roller or wheel 48 that is positioned below the conveyor belt 12. Each lever arm 40, 42 also includes an upper lever arm portion 50 that extends upwardly from the attachment pivot point 45 and terminates in a pushing member 52. In operation, as will be described in more detail, the wheels 48 at the lower ends of the pouch opening lever arms 40, 42 engage a generally planar lifting surface 54 that causes each of the pouch opening lever arms 40, 42 to pivot such that the pushing members 52 at their upper ends tilt into the top of the cup 10 through the notched opening 26. The lever arms 40,42 are positioned such that they press on the edges of the pouch 22 where the edges extend out of the upper end of the guide channels 18, 20. As the push member 52 on each push opening lever arms 40,42 move towards one another, the upper edge of each panel 22*a*, 22*b* is flexed, to open the pouch 22 and to maintain the pouch 22 in an open configuration. The pouch 22 may then be further prepared such as filled or sealed, while remaining in the cup 10.

Figure 4:
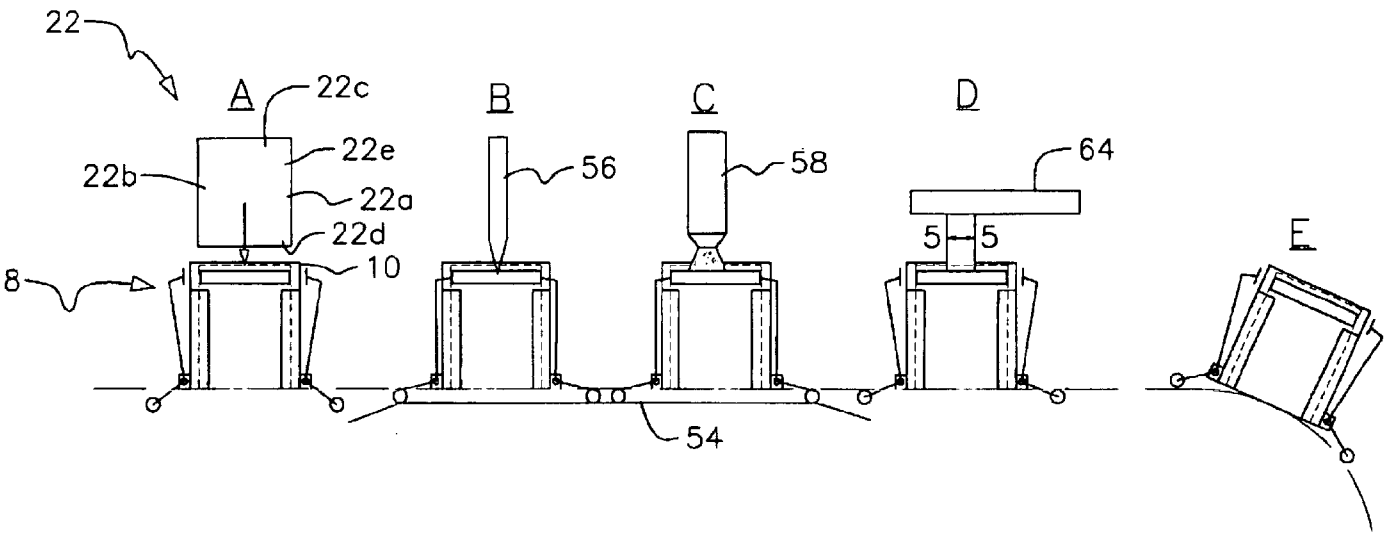
FIG. 4 is a diagrammatic view of a process of operations for opening, filling, and sealing a flexible pouch using the cup member of FIG. 1, according to the present invention.
Figure 5:
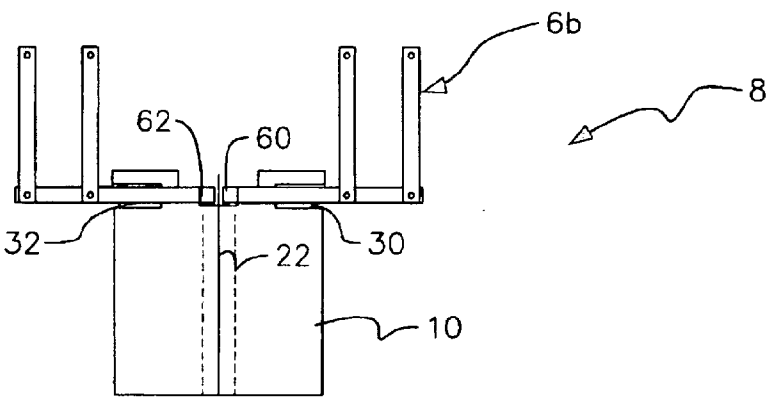
FIG. 5 is an elevational view of a heat sealing member for sealing the pouch, using the process of FIG. 4, according to the present invention.

Referring to FIGS. 4 and 5, a process of operations for manufacturing a flexible pouch is illustrated, using the apparatus described with respect to FIGS. 1–3. The cup 10 is shown moving through various predetermined stations, which are labeled "A", "B", "C", "D", and "E". It is foreseeable that the cup may pass through other stations or operations that are conventionally known in the art, such as a finishing station or the like.

As shown in the "A" operation, the cup 10 is empty and the previously described pouch opening lever arms 40,42 is pivoted outwardly. A pouch 22 is dropped into the cup 10. The pouch 22 is positioned in the cup 10 such that the side edges 22*e* of the pouch 22 are engaged within the guide channels 18,20 in the cylindrical side wall 17.

The apparatus 8 is transported along the conveyor belt to operation "B", and the pouch 22 is opened in an opening operation. At operation "B", the two pouch opening lever arms 40,42 encounter a lifting surface 54. The lifting surface 54 is a generally planar member disposed below the transport means. The wheels 48 on the opening lever arms 40,42 engage the lifting surface 54, causing the pouch opening lever arms 40,42 to pivot such that they press on the side edges 22*e* of the pouch 22. Coordinated therewith, the pouch 22 is opened. Various techniques are conventionally known in the art for further opening the pouch 10. For example, a nozzle 56 may be mechanically lowered into the pouch 22 to direct a stream of compressed gas downwardly into the pouch to force the panel walls of the pouch 22 away from each other to further open an upper edge of the pouch 22. An example of a gas is carbon dioxide or nitrogen. The lever arms 40,42 assist in maintaining the pouch 22 in an open position.

Alternatively, the opening station B may include a manifold (not shown) having a hood that extends over the top of the upper edges of the pouch 22. The manifold has rows of apertures, and the hood is placed over the pouch 22 to assist in maintaining the air pressure in the pouch 22. The supply of pressurized gas is directed through the aperture to form a plurality of jets of pressurized gas or air. The jets are directed downwardly at the diamond-shaped openings formed in the upper edges to assist in overcoming the surface tension of the panels and assist in separation of the panels.

The apparatus 8 is then transported to a filling station, as indicated at operation "C", where the pouch 22 is filled with product by a fill nozzle 58 in a filling operation. In this example, the fill nozzle 58 is lowered into the opened pouch 22, and the product is dispensed into the open pouch 22.

The cup is transported to a sealing operation, as indicated at operation "D", where the pouch is sealed using a conventionally known sealing technique. For example, the upper edges of the pouch 22 are sealed together using a combination of heat and pressure. Another example of a sealing technique is an ultrasonic sealing process. In this example, a combination of heat and pressure is utilized. For example, at the sealing station "D", the lifting surface 54 ends, causing the lever arms 40,42 pivotally to return to their original position, and the pouch 22 to close. It should be noted that the filled pouch 22 might return to a partially closed position due to the product contained therein. In this example, a heat-sealing member 64 extends therethrough the slots 30, 32 in the sides of the cup 10, to seal the upper edge of pouch 22.

Referring to FIG. 5, a pair of heat-sealing members 60, 62 and their support mechanisms are illustrated. In FIG. 5, a cross-section of a cup 10 with a pair of heat-sealing members 60 and 62 sealing a pouch 22 in the cup 10 is shown. The heat-sealing members 60 and 62 are each supported by an articulating mechanism, shown at 66, that allows them to move into the slots 30, 32, squeeze the upper edges of the pouch together, and seal the pouch. Members 60 and 62 are typically heated, so as to partially melt the upper end of the pouch and seal the two sides of the pouch to one another.

Referring back to FIG. 4, a mechanism supporting the heat-sealing members 60, 62 may be on a moveable support 64, so that it can move along with the cup 10 as the apparatus 8 moves along the conveyor belt. Preferably, the process is a continuous process, with the conveyor belt moving at a continuous speed. In this situation, the heat-sealing members 60, 62 need to move along with the cup 10. Alternatively, the conveyor belt may move in discreet steps such that the heat-sealing members 60, 62 do not need to move along with the cup 10.

The apparatus 8 is transported to operation "E", and the pouch 22 is removed from the cup 10. In this example, the transport means 12 curves in a downwardly direction, causing the apparatus 8 to rotate sideways. As this rotation continues, the filled pouch 22 falls out of the cup 10.

It should be appreciated that the process may include other operations. For example, the filled pouch 22 may be transferred to another conveyor belt, or otherwise collected. Alternatively, other stations may include a straw piercable opening station, an upstream oxygen purging station, a downstream oxygen purging station, or the like. In addition, a manufacturing station may perform one or a plurality of operations, to enhance the efficiency of the methodology.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. An apparatus for transporting a flexible pouch during manufacturing operation, said apparatus comprising:

a cylindrical cup member having an open upper end, a closed lower end and a side wall extending therebetween the upper end and lower end, wherein an inside portion of said side wall includes a pair of opposed guide channels for receiving the flexible pouch, said side wall includes a slot positioned adjacent the guide channel, and said side wall includes a notched opening positioned above each guide channel; and a pouch opening lever arm pivotally attached to said side wall of said cup member, wherein said pouch opening lever arm includes a lower portion below the pivotal attachment point having a wheel at an outer end and an upper portion above the pivotal attachment point having an outwardly extending push member at an outer end.

2. An apparatus as set forth in claim 1 wherein said cup member is fixedly attached to a transport means for transporting said apparatus between manufacturing operations.

3. An apparatus as set forth in claim 2 wherein said guide slots are positioned to hold the pouch in a center of said cup member.

4. An apparatus as set forth in claim 3 wherein the notched opening projects in a downwardly direction.

5. An apparatus as set forth in claim 4 wherein said side wall includes two slots each extending partially around the side wall.

6. An apparatus as set forth in claim 4 wherein engagement of said wheels by a lifting surface pivotally moves said pushing member through the notched opening in said cup member to push apart the front and back panel.

7. An apparatus for transporting a flexible pouch during manufacturing operations, said apparatus comprising:

a cylindrical cup member having an open upper end, a closed lower end and a side wall extending therebetween the upper end and lower end, wherein an inside portion of said side wall includes a pair of opposed guide channels for holding the flexible pouch in a center of said cup member, said side wall includes two slots positioned adjacent to the guide channel and each extending partially around the side wall, and the side wall includes a notched opening positioned above each of the guide channels and projecting downwardly; and a pouch opening lever arm pivotally attached to said side wall of said cup member at an attachment point, wherein said pouch opening lever includes a lower portion below the pivotal attachment point having a wheel at an outer end and an upper portion above the pivotal attachment point having an outwardly extending push member at an outer end.

8. An apparatus as set forth in claim 7 wherein said cup member is fixedly attached to a transport means for transporting said apparatus between manufacturing operations.

9. An apparatus as set forth in claim 8 wherein engagement of said wheels by a lifting surface disposed below the transport means pivotally moves said pushing member through the notched opening in said cup member to push apart the front and back panel.

10. A process of manufacturing a filled flexible pouch, said method comprising the steps of:

placing a flexible pouch having a front panel joined to a back panel at side edges and a lower edge and open at an upper edge into a cylindrical cup member having an open upper end, a closed lower end and a side wall extending therebetween the upper end and lower end, an inside portion of the side wall includes a pair of opposed guide channels for receiving the side edges of the flexible pouch, the side wall includes a slot positioned adjacent the guide channel, the side wall includes a notched opening positioned above each of the guide channels, and a pouch opening lever arm pivotally attached to the side wall of the cup member, wherein the pouch opening lever includes a lower portion below the pivotal attachment point having a wheel at an outer end and an upper portion above the pivotal attachment point having an outwardly extending push member at an outer end;

opening the pouch by engaging the wheels of the lever arm by a lifting surface disposed below a transport means to pivotally move the pushing member through the notched opening in the cup member to push apart the front and back panels of the pouch;

filling the pouch with the product using a fill nozzle positioned above the opened pouch;

closing the pouch by pivotally moving the pouch opening lever arm away from the pouch;

sealing the upper edge of the panels of the pouch; and removing the filled pouch from the cup member.

11. A process as set forth in claim 10, wherein said step of opening the pouch further includes the step of directing a stream of compressed gas into the pouch to separate the front and back panels.

12. A method as set forth in claim 11 wherein said step of sealing the upper edges of the panels of the pouch together includes the step of using a combination of heat and pressure, wherein a heat sealing member extends therethrough the slots in the side wall of the cup member to seal the upper edges of the pouch together.

13. A method as set forth in claim 12 wherein said step of removing the filled pouch further includes the step of rotating the cup member until the filled pouch falls out of the cup member.

* * * * *

UNITED STATES PATENT AND TRADEMARK OFFICE

CERTIFICATE OF CORRECTION

PATENT NO. : 6,719,015 B2
DATED : April 13, 2004
INVENTOR(S) : R. Charles Murray It is certified that error appears in the above-identified patent and that said Letters Patent is hereby corrected as shown below:

Title page,
Item [56], References Cited, U.S. PATENT DOCUMENTS, insert the following:

| | | | | |
|---|---|---|---|---|
| -- 5485714 | 1996-01-23 | Montalvo | 53 | 459 |
| 5845466 | 1998-12-08 | Laudenberg | 53 | 568 |
| 6199601 | 2001-03-13 | Laudenberg | 141 | 48 -- |

Column 4,
Line 24, replace “opening” with -- opening --.

Signed and Sealed this

Nineteenth Day of April, 2005

JON W. DUDAS
*Director of the United States Patent and Trademark Office*